US007194966B2

(12) United States Patent
Tajima et al.

(10) Patent No.: US 7,194,966 B2
(45) Date of Patent: Mar. 27, 2007

(54) EMBROIDERY-FRAME MOUNTING STRUCTURE

(75) Inventors: Ikuo Tajima, Kasugai (JP); Aisuke Murase, Kasugai (JP)

(73) Assignee: Tokai Kogyo Mishin Kabushiki Kaisha (JP)

( * ) Notice: Subject to any disclaimer, the term of this patent is extended or adjusted under 35 U.S.C. 154(b) by 0 days.

(21) Appl. No.: 10/563,344

(22) PCT Filed: Jul. 2, 2004

(86) PCT No.: PCT/JP2004/009418

§ 371 (c)(1),
(2), (4) Date: Jan. 3, 2006

(87) PCT Pub. No.: WO2005/003426

PCT Pub. Date: Jan. 13, 2005

(65) Prior Publication Data

US 2006/0162635 A1 Jul. 27, 2006

(30) Foreign Application Priority Data

Jul. 4, 2003 (JP) ..... 2003-192150

(51) Int. Cl.
*D05C 9/04* (2006.01)
*D05C 9/00* (2006.01)

(52) U.S. Cl. ..... 112/103

(58) Field of Classification Search ..... 112/103, 112/470.14, 470.18, 475.11, 475.18; 38/102.2
See application file for complete search history.

(56) References Cited

U.S. PATENT DOCUMENTS 4,834,006 A * 5/1989 Goto ..... 112/103
4,993,333 A * 2/1991 Moore, III ..... 112/103
5,353,725 A * 10/1994 Sakakibara ..... 112/103
6,457,428 B1 * 10/2002 Vickroy ..... 112/103

FOREIGN PATENT DOCUMENTS

| | | |
|---|---|---|
| JP | 1-260052 A | 10/1989 |
| JP | 3-130456 A | 6/1991 |
| JP | 8-311762 A | 11/1996 |
| JP | 9-78438 A | 3/1997 |
| JP | 2598313 Y2 | 6/1999 |

* cited by examiner

*Primary Examiner*—Ismael Izaguirre
(74) *Attorney, Agent, or Firm*—Rossi, Kimms & McDowell LLP

(57) ABSTRACT

An embroidery frame for holding an embroidering fabric in a spread-out condition is detachably attached to mounting members at a predetermined position. Positioning members are removably fixed to a base frame at a predetermined position. The mounting members are attached to the positioning members so that their mounted positions relative to the positioning members are adjustable, so that the embroidery frame is adjustably and removably mounted on the base frame via the mounting members and the positioning members. Once the position of the mounting members relative to the positioning members has been established, and when the mounting members are to be detached from the base frame, the mounting members only have to be detached together with the positioning members so that the relative positional relationship between the adjusted positional state of the mounting members relative to the positioning members can be maintained.

5 Claims, 7 Drawing Sheets

EMBROIDERY-FRAME MOUNTING STRUCTURE

This application is a U.S. National Phase Application of PCT International Application PCT/JP2004/009418 filed on Jul. 2, 2004 and claims priority from JP 2003-192150 filed on Jul. 4, 2003.

TECHNICAL FIELD

The present invention relates to an improvement in the structure for mounting an embroidery frame, holding an embroidering (i.e., to-be-embroidered) fabric or other embroidering workpiece, to a base frame driven on the basis of embroidering data.

BACKGROUND ART

There are a great variety of embroidered products, among which are known those made using a combination of embroidery and sewing of a strand-like member and using a combination of embroidery and laser processing. Examples of the known sewing machines for making such embroidered products include ones that are provided with an embroidery sewing machine head and a machine head capable of sewing a strand-like member, and ones that are provided with an embroidery sewing machine head and laser head capable of laser processing.

In addition to the foregoing, it has been proposed to sew a strand-like member to an embroidering workpiece or laser-process the embroidering workpiece, after having performed a given embroidery operation on the embroidering workpiece with an embroidery frame attached to the embroidery sewing machine, then detaching the embroidery frame from the embroidery sewing machine to re-attach the same embroidery frame as-is (i.e., with the embroidering workpiece still held on the embroidery frame) to another embroidery sewing machine capable of sewing a strand-like member to the embroidering workpiece or to a laser processing machine. However, if the embroidery frame is merely attached to the other embroidery sewing machine or laser processing machine, the sewing of the strand-like member or laser processing would be performed with undesired positional deviation relative to the already-embroidered pattern. One example solution to the problem is disclosed in Patent Literature 1 below.

Patent Literature 1: Japanese Patent Application Laid-open Publication No. HEI-8-311762.

According to the technique disclosed in Patent Literature 1 above, a base frame, which is movable in X and Y directions on the basis of embroidering data, is provided with a pair of mounting members per machine head for removably attaching the embroidery frame. The two mounting members are provided respectively on rear and front regions, in the Y direction, of the base frame in such a manner that their respective positions are adjustable as necessary. In this way, each embroidery frame is adjustable in its mounted position relative to the base frame, and thus, the mounted positions of the embroidery frames on the individual machine heads of the embroidery sewing machine can be adjusted to same or corresponding positions.

In creating an embroidered product as illustrated in FIG. 13, for example, the technique disclosed in Patent Literature 1 above can avoid positional deviation in any embroidered pattern. In FIG. 13, reference numeral 30 represents an embroidery made onto an embroidering fabric a, and 31 a strand-like member sewn onto the embroidering fabric a. In the figure, point "A" is a start point of embroidering data for the embroidery 30, while point "B" is a start point of data for the strand-like member 31. Connecting data L is set for connection from point A to point B. Adjustments are made in advance to respective embroidery-frame mounting positions on the embroidery sewing machine for making the embroidery 30 in the forgoing manner and on a handle sewing machine for sewing the strand-like member. First, the embroidery frame holding the embroidering fabric a is mounted on the embroidery sewing machine to make the embroidery 30. After completion of the making of the embroidery 30 by the embroidery sewing machine, the embroidery frame is dismounted from the embroidery sewing machine, and then the same embroidery frame is mounted on the handle sewing machine. Then, a human operator operates a frame movement key on an operation panel of the handle sewing machine to thereby move the base frame so that the start point A of the embroidery 30 aligns with a needle drop point or position. Once the handle sewing machine is activated, the base frame is caused to travel over a distance defined by the connecting data L. Then, once point B reaches the needle drop position, the sewing operation is started to sew the strand-like member 31. Embroidered product completed in this manner can present a superior aesthetic quality without the embroidery 30 and strand-like member 31 being positionally deviated from each other.

However, with the technique disclosed in Patent Literature 1, the mounted positions, relative to the base frame, of the mounting members are adjusted directly. Thus, where the mounting members are to be temporarily dismounted from the base frame and then again mounted on the base frame, the operation for adjusting the mounted positions, relative to the base frame, of the mounting members has to be repeated, which tends to be very cumbersome.

For example, the adjustment of the mounted positions relative to the base frame is performed using positioning jigs capable of being attached to the base frame in place of the embroidery frame. The positioning jig has two predetermined reference marks (e.g., "+" marks) imprinted thereon, and these reference marks are spaced from each other, for example, in the Y direction. Generally, the mounted position adjustment has to be performed individually for each of the reference marks.

More specifically, the positioning jig is first attached to the base frame in place of the embroidery frame of the first machine head, at which time the mounting members are temporarily fixed in position. Then, the frame movement key on the operation panel is operated to move the base frame, so as to substantially align one of the "+" marks (one near the rear end of the jig) with the axis center of a selected needle (needle drop position) of the first machine head. Then, the position of the rear-side mounting member is adjusted to bring the rear "+" mark into complete alignment with the needle drop position. After that, the positioning jig is detached from the first machine head and then reattached to the second machine head, and then the position of the rear-side mounting member is adjusted to bring the rear-side "+" mark into complete alignment with the needle drop position. In a similar manner, the position adjustment of the rear-side mounting member is performed for the other machine heads. After that, the jig is again attached to the first machine head, and then the frame movement key on the operation panel is operated to move the base frame in the Y direction to thereby bring the front "+" mark close to the needle drop position. The position of the front-side mounting member is adjusted to bring the front "+" mark into alignment with the needle drop position. In a similar manner, the position adjustment of the front-side mounting member is performed for the other machine heads. In this way, the mounted positions of the embroidery frames on the individual machine heads can be adjusted to same or corresponding positions.

Generally, an embroidering fabric is attached in one of two ways: the first way in which a plurality of the embroidery frames are attached in corresponding relation to a plurality of the machine heads as in the above-described prior art technique (only one embroidery frame is attached in the case of a single-head machine); and the second way where a so-called raw fabric is attached directly to the base frame in a stretched manner. In the case where a raw fabric is attached directly to the base frame, it is necessary to first dismount the mounting members that attach the embroidery frames to the base frame and then mount a sash member, having protrusions, to the four sides of the base frame. The protrusions serve to hold the raw fabric in a sandwiched manner by engaging with known raw fabric clips. When desired embroidery is to be performed on the raw fabric by detaching the embroidery frame from the base frame together with the mounting members and then attaching the fabric directly to the base frame in a stretched and then the embroidery is to be again performed using the same embroidery frame, it is necessary for the technique of Patent Literature 1 Patent Literature 1 to reattach the detached mounting members so as to again adjust the mounted positions of the mounting members. Because the mounted position adjustment operation is very cumbersome and time-consuming, it would lead to a lowered efficiency of the embroidery operation. Particularly, in the case where the embroidery sewing machine is provided with many (e.g., 20) machine heads, it would take much time and labor to adjust the mounted positions of the embroidery frames each time the mounting members are detached and reattached.

Namely, the conventional technique is arranged to directly adjust the mounted positions of the mounting members relative to the base frame. Thus, in the case where the mounting members are temporarily detached from the base frame and then reattached to the base frame, the operation for adjusting the mounted positions of the mounting members relative to the base frame has to be repeated, so that the entire embroidery sewing machine has to be kept in a halt or non-operating state for a long time. As a consequence, the conventional technique can only achieve poor productivity.

DISCLOSURE OF THE INVENTION

In view of the foregoing, it is an object of the present invention to provide a technique which, when a mounting member is to be detached from a base frame, can minimize time and labor necessary for adjustment of a mounted position of the mounting member to thereby simplify the detachment/attachment of the mounting member and enhance the operational efficiency.

The present invention provides an embroidery-frame mounting structure for mounting an embroidery frame, holding an embroidering fabric in a spread-out condition, on a base frame driven relative to a tool, which comprises: a mounting member that removably attaches the embroidery frame to the base frame at a predetermined position; and a positioning member removably fixed to the base frame at a predetermined position. In the present invention, the mounting member is attached to the positioning member in such a manner that a mounted position thereof relative to the positioning member is adjustable, so that the embroidery frame is adjustably and removably mounted on the base frame via the mounting member and the positioning member.

The base frame is driven relative to the tool (e.g., machine head) on the basis of embroidering data; for example, the base frame is driven in the X and Y directions substantially parallel to a table surface of an embroidery sewing machine. The base frame allows embroidery to be performed on an embroidering fabric, held on the embroidery frame, on the basis of the embroidering data. According to the present invention, the embroidery frame is removably secured to the mounting member, the positioning member is removably fixed to the base frame at a predetermined position, and the mounting member is mounted on the base frame via the positioning member. Also, the mounted position of the mounting member relative to the positioning member can be adjusted as desired. Namely, adjusting the position of the mounting member relative to the positioning member allows a mounted position of the base frame relative to the base frame to be set and adjusted as appropriate.

Thus, when the mounting member is to be removed from the base frame, it can be removed from the base frame along with the positioning member stilled secured to the mounting member. Thus, the mounting member can be removed from the base frame with its position relative to the positioning member and hence to the base frame of the embroidery frame still maintained. Because the positioning member is fixed to the base frame at a predetermined position, the mounting member can be mounted at the same position as before the removal, when the mounting member is to be again mounted on the base frame.). Therefore, once the position of the mounting member relative to the positioning member has been established, and when the mounting member is to be detached from the base frame, there is no need to repeat the mounted position adjustment of the embroidery frame (mounting member). As a consequence, the mounted position of the mounting member does not have to be re-adjusted each time the mounting member is removed from and again mounted on the base frame, which can thus eliminate the inconveniences that the embroidery sewing machine has to be kept in a halt state for a long time.

BEST MODE FOR CARRYING OUT THE INVENTION

Embodiments of the present invention will now be described with reference to the accompanying drawings.

Figure 1:
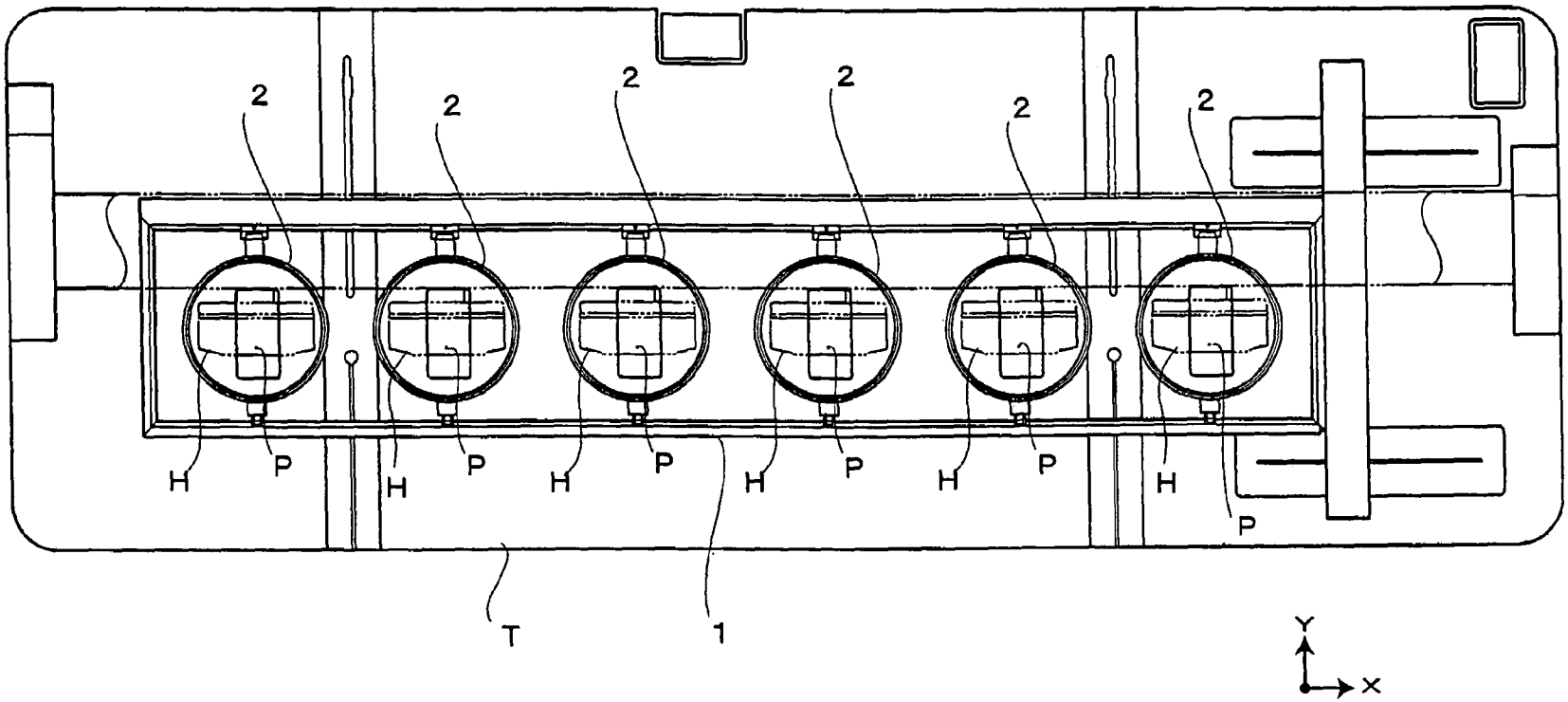
FIG. 1 is a plan view showing a general setup of a multi-head embroidery sewing machine in accordance with an embodiment of the present invention.
Figure 2:
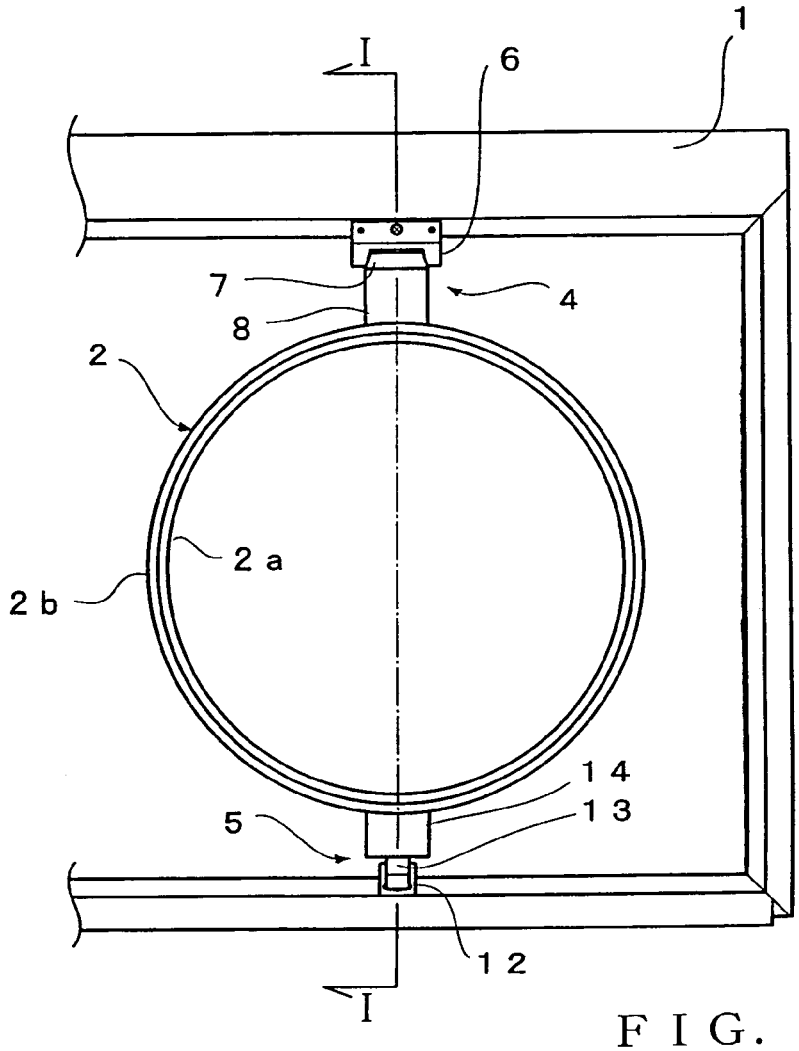
FIG. 2 is a plan view showing in enlarged scale one of embroidery frames shown in FIG. 1.
Figure 3:
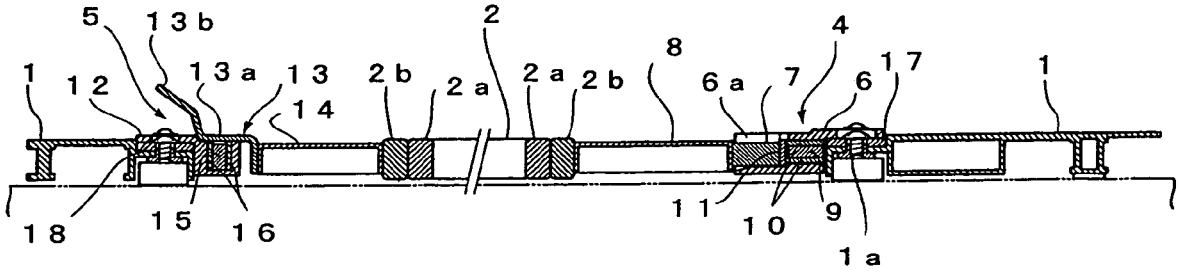
FIG. 3 is a sectional view taken along the I—I line of FIG. 2.

FIG. 1 is a plan view showing a general setup of a multi-head embroidery sewing machine, FIG. 2 is a plan view showing in enlarged scale one of embroidery frames 2, i.e. the rightmost embroidery frame in FIG. 1, and FIG. 3 is a sectional view taken along the I—I line of FIG. 2.

In FIG. 1, a base frame 1, having a rectangular shape as viewed in plan, is placed on a table T of the multi-head embroidery sewing machine that is provided with a plurality of machine heads (in the illustrated example, six machine heads) H. The base frame 1 is movable, via a not-shown X-axis drive mechanism and Y-axis drive mechanism, in the X-axis and Y-axis directions in substantially parallel to the surface of the table T. Six embroidery frames 2 are removably attached to the base frame 1 in corresponding relation to the six machine heads H. As seen in FIGS. 2 and 3, each of the embroidery frames 2 includes a ring-shaped inner frame portion 2*a*, and a ring-shaped outer frame portion 2*b* disposed around the outer periphery of the inner frame 2*a*. The embroidering workpiece is held on the embroidery frame 2 by being sandwiched between the inner and outer frame portions 2*a* and 2*b*. Each of the embroidery frames 2 is connected to the base frame 1 by means of a first connection mechanism 4 via an arm 8 extending in the Y direction from its rear portion (i.e., from an upper portion in the figure), and by means of a second connection mechanism 5 via an arm 14 extending in the Y direction from its front portion (i.e., from a lower portion in the figure). Note that a reference character P in FIG. 1 indicates a needle drop point or position of each of the machine heads H.

The first connection mechanism 4 includes a first support member (or first mounting member) 6 provided on one side of the base frame 1, and a first connection member 7 provided at an end of the arm 8 extending from the rear portion of the embroidery frame 2. As seen in FIG. 3, the first support member 6 has a fitting recess portion 6*a* formed therein to restrict movement of the first connection member 7, and also has a magnet 9 and two magnetic plates 10 embedded therein. With the first connection member 7 of the embroidery frame 2 closely fit in the fitting recess portion 6*a*, the embroidery frame 2 can be attached to the first support member (mounting member) 6 at a fixed position. The first connection member 7 has a metal attachment plate 11 secured to its distal end surface. As the first connection member 7 is engaged in the fitting recess portion 6*a*, the attachment plate 11 is attached to the fitting recess portion 6*a* by a magnetic force, so that the first connection member 7 is connected with the first support member 6.

The second connection mechanism 5 includes a second support member (or second mounting member) 12 provided on the base frame 1, and a second connection member 13 provided at an end of the arm 14 extending from the front portion of the embroidery frame 2. As seen in FIG. 3, the second support member 12 too has a fitting recess portion 12*a* formed in its upper surface, and has a magnet 15 and two magnetic plates 16 embedded therein. Respective one surfaces of the two magnetic plates 16 together constitute a part of a bottom surface of the fitting recess portion 12*a*. The second connection member 13 integrally has an attachment portion 13*a* engageable with the fitting recess portion 12*a* and a grip portion 13*b* extending upward from the attachment portion 13*a*. With the second connection member 13 of the embroidery frame 2 closely fitted in the fitting recess portion 12*a*, the embroidery frame 2 can be attached to the second support member (second mounting member) 12 at a fixed position. As the attachment section 13*a* of the second connection member 13 is engaged in the fitting recess portion 12*a* of the second support member 12, the attachment plate 13*a* is attached to the fitting recess portion 12*a* by a magnetic force, so that the second connection member 13 is connected with the second support member 12. In the above-described manner, the embroidery frame 2 can be removably attached to the first and second support members (or mounting members) 6 and 12.

As seen in FIG. 3, the first and second support members 6 and 12 are secured to the base frame 1 via first and second positioning plates 17 and 18, respectively.

Figure 4:
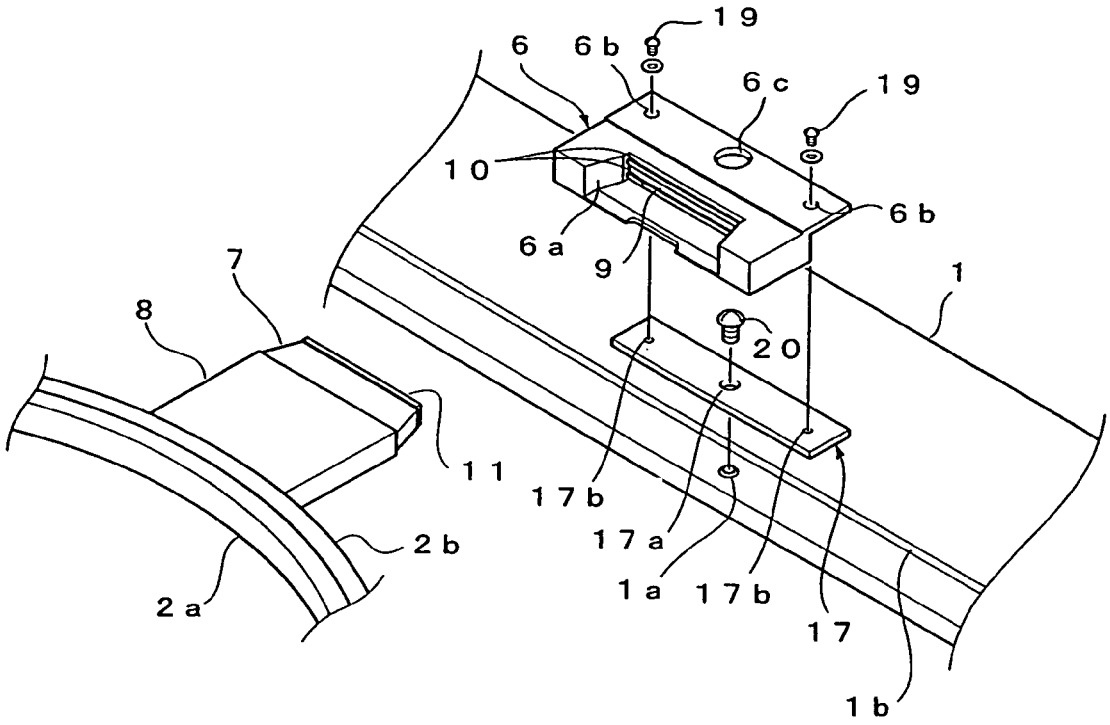
FIG. 4 is an enlarged, exploded perspective view showing a manner in which a first support member and a first positioning member are mounted in the embodiment.

As seen in FIG. 4, the first positioning plate 17 is a plate-shaped member that has two mounting holes 17*b* for fitting therein of two screws 19 to secure the first support member 6 and a mounting hole 17*a* for securing the positioning plate 17 itself to the base plate 1 by means of a screw 20. The first support member 6 has two mounting holes 6*b* for engagement with the screws 19. The first support member 6 is secured to the first positioning plate 17 by means of the two screws 19, and the first positioning plate 17 is secured to the base 1 by means of the screw 20. In this manner, the first support member 6 is attached via the positioning plate 17 to the base frame 1.

The mounting holes 6*b* of the first support member 6 are each formed into an appropriate size, greater than the diameter of the screw 19, to permit adjustment of the mounted position of the support member 6 relative to the positioning plate 17. Thus, the first support member 6 can be adjusted in position in the front-and-rear and left-and-right directions within the range permitted by the mounting holes 6*b*. The adjustment of the mounted position of the first support member 6 relative to the first positioning plate 17 is performed in order to adjust the embroidery frame 2 to a desired mounted position, as will be later detailed. The screws 19 are each fixed via a washer.

The mounting hole 17*a* of the first positioning plate 17 is formed so as to engage with a nut member 1*a* on the base frame 1 at a position where the back surface of the first positioning plate 17 contacts a shoulder portion 1*b* of the base frame 1. Namely, the first positioning plate 17 is secured to the base frame 1 at a predetermined position thereof defined by the nut member 1*a*. By engaging the mounting hole 17*a* with the nut member 1*a* with the back surface of the first positioning plate 17 abutted against the shoulder portion 1*b*, the first positioning plate 17 can be fixed to the base frame 1 at that predetermined position with no inclination. Note that an escape hole 6*c* is formed in a substantial middle portion of the first support member 6 to allow escape, from the support member 6, of a head portion of the screw 20.

Figure 5:
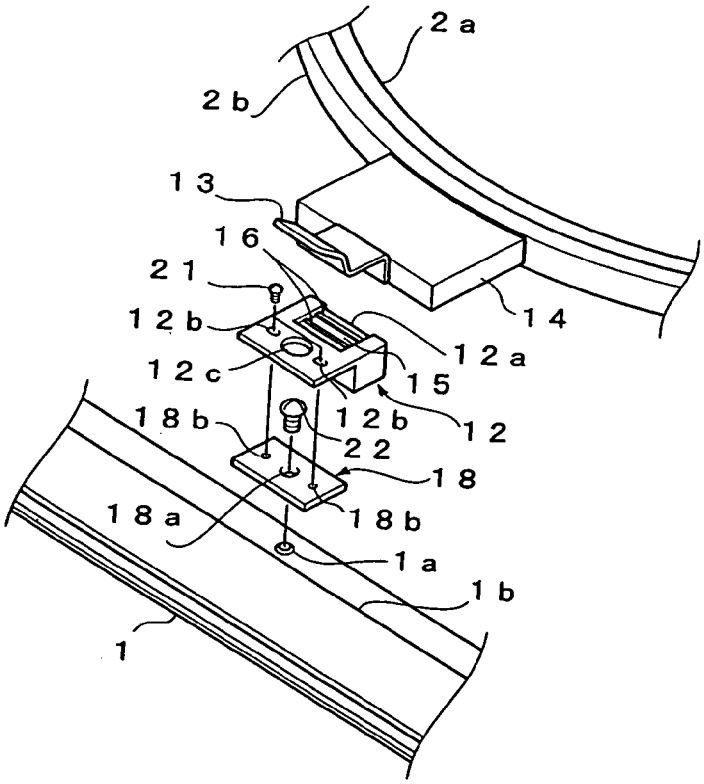
FIG. 5 is an enlarged, exploded perspective view showing a manner in which a second support member and a second positioning member are mounted in the embodiment.

As illustrated in FIG. 5, the second positioning plate 18 is a plate-shaped member that has two mounting holes 18*b* for fitting therein of two screws 21 to secure the second support member 12 and a mounting hole 18*a* for securing the positioning plate 18 itself to the base plate 1 by means of a screw 22. The second support member 12 has two mounting holes 18*b* for engagement with the screws 21. The second support member 12 is secured to the second positioning plate 18 by means of the two screws 21, and the second positioning plate 18 is secured to the base 1 by means of the screw 22. In this manner, the second support member 12 is attached via the positioning plate 18 to the base frame 1.

The second support member 12 has a horizontally-elongated mounting hole 12*b* (elongated in the X direction of FIG. 1) so as to permit adjustment of the mounted position of the second support member 12 relative to the positioning plate 18. Thus, the mounted position of the second support member 12 relative to the positioning plate 18 is adjustable in the left-and-right direction within the range permitted by the mounting holes 12*b*. The adjustment of the mounted position of the second support member 12 relative to the second positioning plate 18 is performed in order to adjust the embroidery frame 2 to a desired mounted position, as will be later detailed.

The mounting hole 18*a* of the second positioning plate 18 is formed so as to engage with the nut member la on the base frame 1 at a position where the front surface of the second positioning plate 18 contacts the shoulder portion 1*b* of the base frame 1. Namely, the second positioning plate 18 is secured to the base frame 1 at a predetermined position thereof defined by the nut member 1*a*. By engaging the mounting hole 18*a*with the nut member 1*a* with the front surface of the second positioning plate 18 abutted against the shoulder portion 1*b*, the second positioning plate 18 can be fixed to the base frame 1 at the predetermined position with no inclination. Note that an escape hole 12*c* is formed in the second support member 12 to allow escape, from the support member 12, of a head portion of the screw 22.

Because the first positioning plate 17 is constantly fixed to the base frame 1 at the predetermined position, the mounted position, relative to the frame 1, of the first support member 6 can be fixed at a predetermined location corresponding to the fixed position of the first positioning plate 17, if the position of the first support member 6 relative to the first positioning plate 17 is fixed. Similarly, because the second positioning plate 18 is constantly fixed to the base frame 1 at the predetermined position, the mounted position, relative to the frame 1, of the second support member 12 can be fixed at a predetermined location corresponding to the fixed position of the second positioning plate 18, if the position of the second support member 12 relative to the second positioning plate 18 is fixed. Thus, the frame 1 can be fixedly mounted relative to the embroidery frame 2 at a position corresponding to the fixed positions of the first and second positioning plate 17 and 18.

Further, because the support members 6 and 12 holding the embroidery frame 2 are fixed on the base frame 1 via the first and second positioning plates 17 and 18, the mounted position, relative to the base frame 1, of the embroidery frame 2 can be adjusted by adjusting the positions of the support members 6 and 12 relative to the positioning plates 17 and 18.

As set forth above, the support members (mounting members) 6 and 12 have to be detached from the base frame 1 in order to set an embroidering fabric or material directly on the base frame 1 in a stretched manner. According to the present invention, the support members 6 and 12 are detached from the base frame 1 together with the positioning plates 17 and 18, so that the relative positional relationship between the support members 6 and 12 and the positioning plates 17 and 18, i.e. the adjusted mounted position of the embroidery frame 2, can be maintained just as before. In reattaching the once-removed support members 6 and 12 to the base frame 1, the two positioning plates 17 and 18 can be fixed at the predetermined positions relative to the base frame 1, and thus, the support members 6 and 12 can also be fixed at the same positions as before the detachment. Because the support members 6 and 12 can be maintained at the same adjusted mounted positions as before the detachment, there is no need to re-adjust the mounted positions each time the support members 6 and 12 are to be reattached after detachment from the base frame 1. Consequently, no time and labor is necessary for adjusting the embroidery frame 2 when the support members 6 and 12 are reattached after the detachment, so that the detaching/attaching operation can be simplified; thus, the present invention can enhance the operating efficiency even with sewing machines having a plurality of (e.g., twenty) machine heads. Further, in the present invention, the first and second positioning plates 17 and 18 can be fixed at the predetermined positions by only engaging the nut members 1*a* and mounting holes 17*a*, and screwing operation only has to be performed at one position; therefore, the overall detaching/attaching operation can be very simple and easy.

When the embroidery frame 2 is to be detached from the base frame 1, it is only necessary to cancel the connections by the first and second connection mechanisms 4 and 5 by lifting the embroidery frame 2 while holding the grip portion 13*b* of the second connection member 13. As the embroidery frame 2 is lifted by the human operator holding the grip portion 13*b*, the connection, via the magnet 15, between the second connection member 13 and the second support member 12 is canceled, and then the connection, via the magnet 9, between the first connection member 7 and the first support member 6 is canceled; in this way, the embroidery frame 2 can be detached from the base frame 1.

Figure 6:
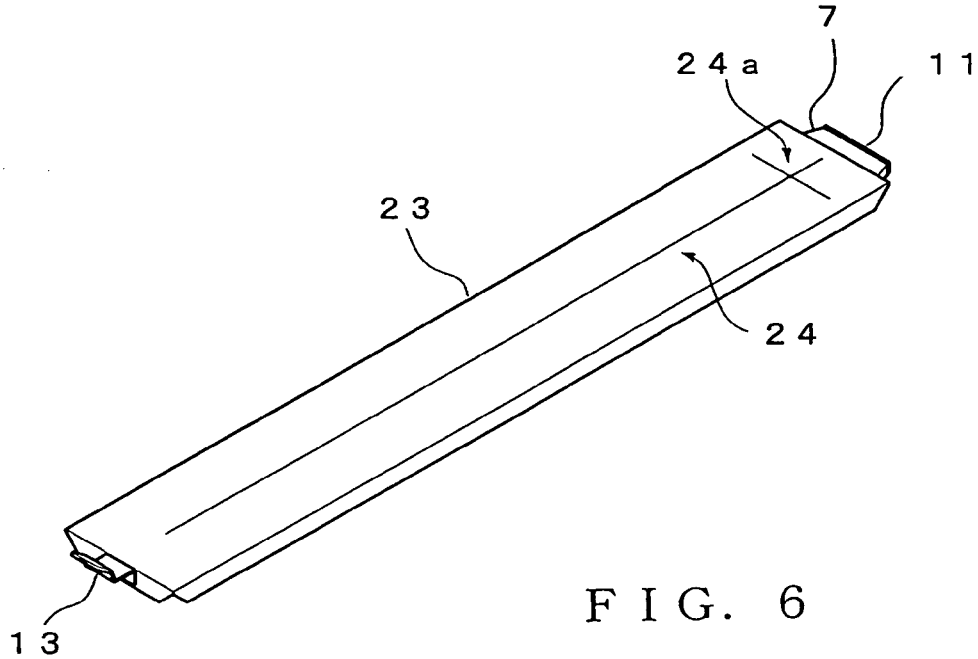
FIG. 6 is a perspective view showing an example of a positioning gauge in the embodiment.
Figure 7:
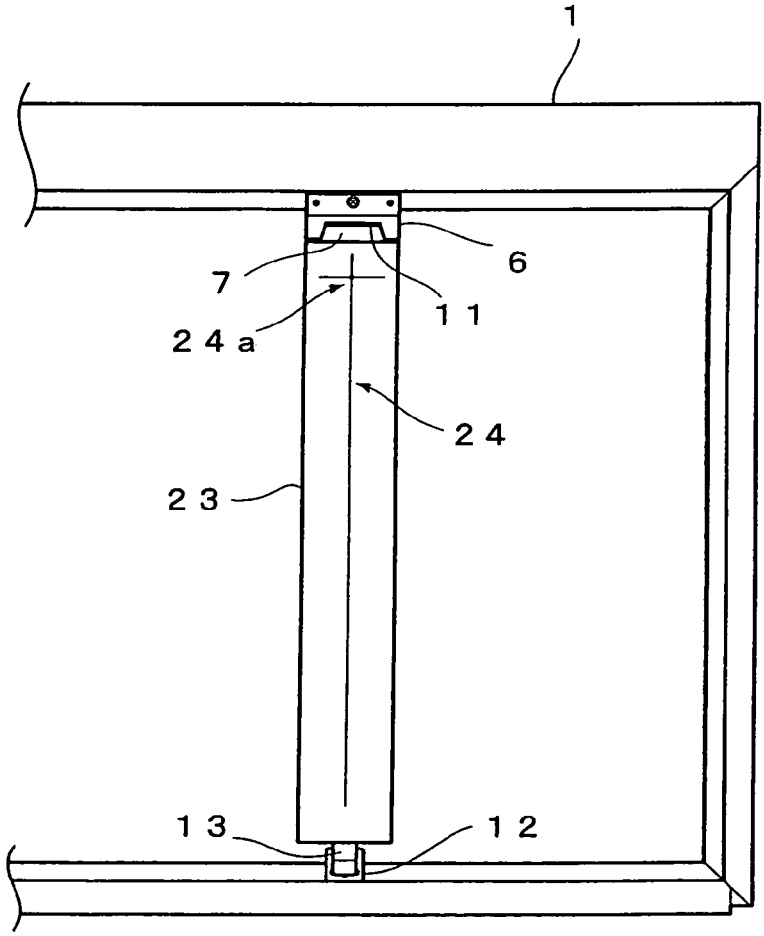
FIG. 7 is a plan view showing the positioning gauge of FIG. 6 attached to base frame.

Now, a description will be given about adjustment of the mounted position of the embroidery frame 2 relative to the base frame 1. FIG. 6 shows a positioning gauge 23 that is a mounting jig for determining a mounted position, relative to the base frame 1, of the embroidery frame 2. FIG. 7 is a plan view showing the positioning gauge 23 attached to base frame 1. The positioning gauge 23 is in the form of an elongated member of a predetermined width. The positioning gauge 23 has, at one of opposite longitudinal ends thereof, a first connection member 7 with an attachment plate 11 similar to that provided at the end of the arm 8 of the embroidery frame 2, and it has, at the other longitudinal end, a second connection member 13. The positioning gauge 23 is attachable to the embroidery frame 2 in place of the embroidery frame 2. These attachment plate 11, first connection member 7 and second connection member 13 are constructed generally in the same manner as the above-described components of the same reference numerals, and thus, a detailed description of these components is omitted here. Guide line 24 having an intersection point 24*a* is formed in and along the length of the positioning gauge 23. The guide line 24 and intersection point 24*a* function as a reference for determining a mounted position of the embroidery frame 2.

Figure 9:
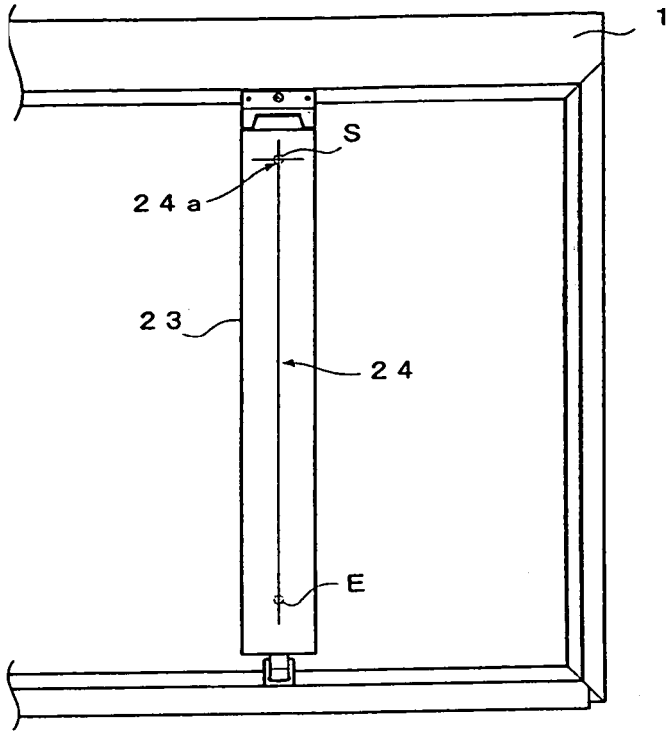
FIG. 9 (PRIOR ART)
FIG. 9 is a plan view showing relationship between the positioning data and the positioning gauge in the embodiment.
Figure 13:
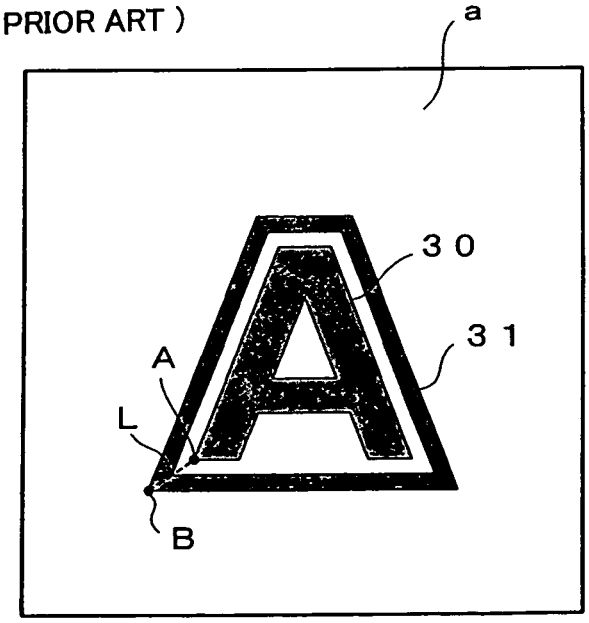
FIG. 13 is a view showing an example manner in which is made an embroidery product requiring detachment/reattachment of an embroidery frame.

Now, a description will be given about an example manner in which the position of the embroidery frame 2 is adjusted using the positioning gauge 23. First, the embroidery frame 2 of the first machine head (i.e., rightmost machine head in FIG. 1) is detached, the relative position of the first support member 6 to the first positioning plate 17 is provisionally fixed centrally in an adjustment range (vertical/horizontal directions), and then the positioning gauge 23 is attached in place. The reason why the first support member 6 is positioned centrally in the adjustment range is to secure the adjustment range for the other machine heads, in order to adjust the mounted position of the first support member 6 of the other machine heads with the first machine head as a positioning reference. Then, the sewing machine is caused to read positioning data for a length from an S (start) point to an E (end) point (e.g. embroidering data of running stitches having a stitch length of, for example, 5 mm). In FIG. 9, there is shown correspondency between the positioning data and the positioning gauge 23. As seen in FIG. 9, the positioning data is set to a length such that the E point is located near the front end of the guide line 24 when the S point is registered with the intersection point 24*a* of the positioning gauge 23. When the positioning data is used, only the base frame 1 is moved on the basis of the positioning data with all of the machine heads H kept deactivated. The human operator operates the frame movement key on the operation panel (not shown) of the sewing machine, so as to bring the intersection point 24*a* of the positioning gauge 23 into registration with the needle drop position (P in FIG. 1) of the machine head H (state illustrated in FIG. 9). Then, the sewing needle (needle bar) at the needle drop position is lowered to move the needle point closer to the upper surface of the positioning gauge 23 for proper positioning thereof. After that, as the embroidery sewing machine is activated and driven in accordance with the positioning data, the base frame 1 is moved until the E point of the positioning gauge 23 is brought into registration of the needle drop position P. After the E point has arrived at the needle drop position P, the human operator adjusts the position of the second support member 12 relative to the second support member so that the guide line 24 of the positioning gauge 23 registers with the needle drop position P. The mounted position of the second support member 12 can be adjusted in the left-and-right direction within the range of the mounting holes 12*b* of the support member 12.

As well known, the embroidery sewing machine is equipped with a function to store the start position of the last-embroidered pattern, so that, upon completion of the embroidery, the base frame 1 can be moved back to the start position either automatically or manually through key operation on the operation panel. Let it be assumed that settings have been made, in the instant embodiment, to return the base frame 1 to the start position (i.e., return the S point to the needle drop position P) in response to operation on the operation panel after completion of the mounted position adjustment of the second support member 12.

After having operated the operation panel to return the base frame 1 to the start position, the human operator ascertains whether the intersection point 24*a* of the positioning gauge 23 is surely in registration with the needle drop position P. This is intended to confirm whether or not the previously-aligned intersection point 24*a* and needle drop position P have been displaced from each other as a result of the adjustment of the second support plate 12, so as to mount the positioning gauge 23 (and hence the embroidery frame 2) on the base frame 1 with no inclination relative to the latter. If the intersection point 24*a* has been displaced from the needle drop position P, the base frame 1 is moved to align the intersection point 24*a* with the needle drop position P, and then the embroidery sewing machine is activated to adjust the mounted position of the second support member 12 so that the guide line 24 registers with the needle drop position P at the E point. After that, the base frame 1 is moved back to the start position, and it is then ascertained whether the intersection point 24*a* is currently in registration with the needle drop position P.

If it has been confirmed that the intersection point 24*a* is in registration with the needle drop position P, the screw 19 is tightened to fix the first support member 6 having been temporarily fixed. In this way, the positions of the support members 6 and 12, and hence the mounted position of the embroidery frame 2, in the first machine head are adjusted.

Then, the human operator detaches the positioning gauge 23 having been attached to the first machine head and re-attaches the positioning gauge 23 to the second machine head (second one from the rightmost end of FIG. 1). Because, at this stage, the base frame 1 is at the start position, the first support member 6 of the second machine head is adjusted in position such that the intersection point 24*a* of the positioning gauge 23 is brought into alignment with the needle drop position P in the second machine head and temporarily fixed at the adjusted position. After that, the embroidery sewing machine is driven in accordance with the positioning data until the E point is brought into registration of the needle drop position P, and the mounted position of the second support member 12 of the second machine head is adjusted so that the guide line 24 registers with the needle drop position P, in the manner as described above. Then, the human operator performs operation to return the base frame 1 to the start position, after which the human operator ascertains that the intersection point 24*a* of the positioning gauge 23 is surely in registration with the needle drop position P and then fixes the first support member 6 having been temporarily fixed so far. If it has been determined that the intersection point 24*a* is not in registration with the needle drop position P, the human operator again adjusts the mounted position of the first support member 6 to ultimately fix the member 6. In this way, the mounted position of the embroidery frame 2 in the second machine head is adjusted. After that, the operations performed for the second machine head are repeated for the third machine head, fourth machine head, and so on. In this manner, the needle drop positions P of all of the machine heads can be placed in alignment with the intersection point 24*a* of the positioning gauge 23, at the start position S, and the embroidery frames 2 of all of the machine heads H can be mounted at the same positions with respect to the corresponding needle drop positions P.

Figure 10:
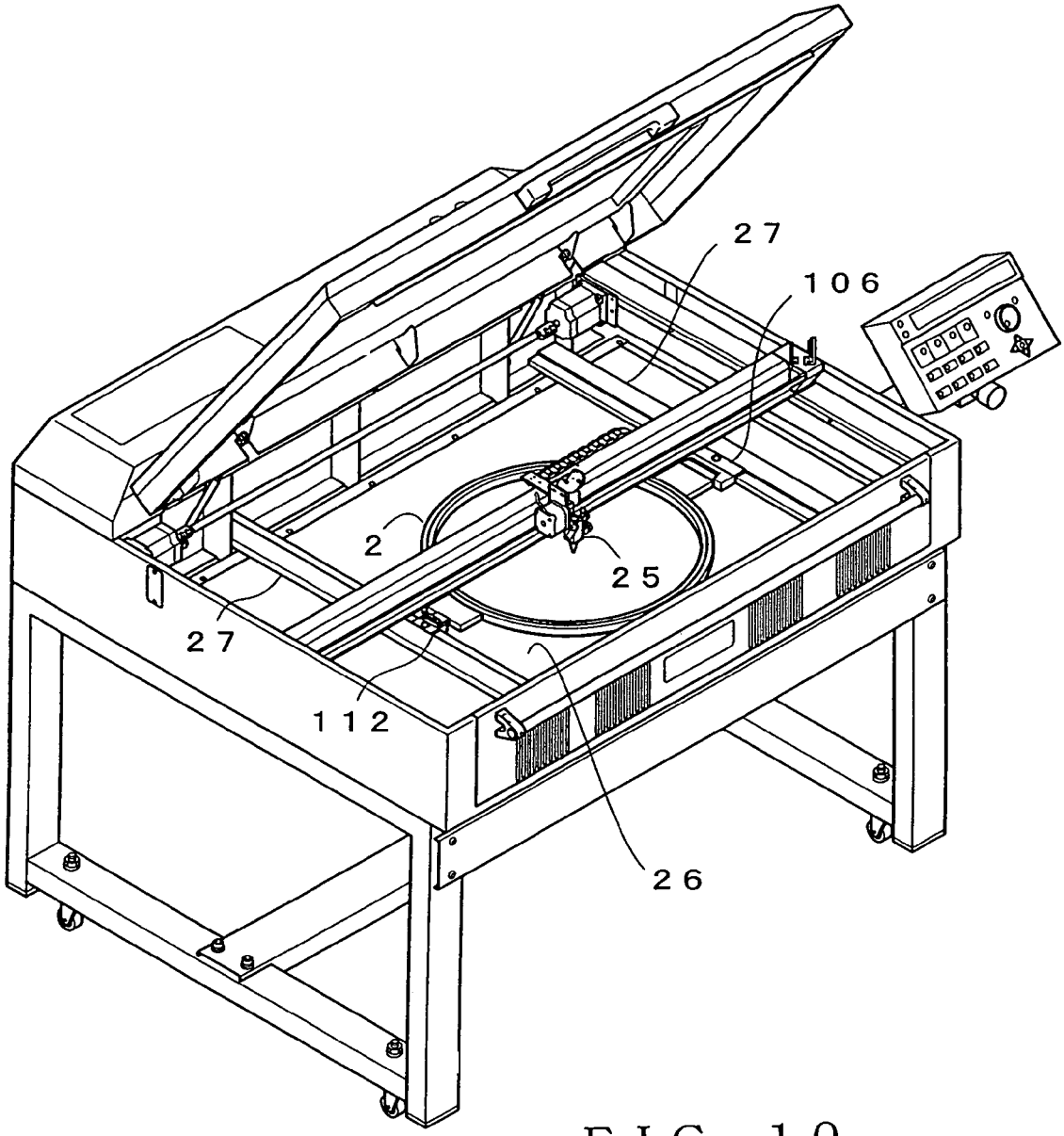
FIG. 10 is a perspective view showing an example of a laser processing machine employed in the embodiment.

In the present invention, the embroidery frame 2 can also be mounted on a laser processing machine, to perform laser processing (e.g., cutting by a laser beam) on a workpiece having an embroidery applied thereto. How to mount the embroidery frame 2 on the laser processing machine will be explained below. FIG. 10 is a perspective view showing an example of the laser processing machine. As well known, the laser processing machine includes a single laser head 25 driven, by a drive mechanism, in the X and Y directions, and a table 26 for placing thereon a workpiece under the laser head 25. Over the table 26, there are provided support members 27 for mounting thereon first and second support members 106 and 112. In the illustrated example of FIG. 10, the support members 27 are disposed to allow the embroidery frame 2 to be mounted in horizontal orientation, due to limitations of a mounting space. The first and second support members 106 and 112 are constructed in a similar manner to the above-described first and second support members 6 and 12 for mounting the embroidery frame 2 to the base frame 1 of the embroidery sewing machine, and thus, these support members 106 and 112 will be explained, quoting FIGS. 4 and 5 as necessary, with detailed illustration thereof omitted. Namely, similarly to the above-described first and second support members 6 and 12 in the embroidery sewing machine shown in FIGS. 4 and 5, the first and second support members 106 and 112 in the laser processing machine include first and second positioning plates, respectively, that correspond to the first and second positioning plates 17 and 18, and they are secured to the support members 27 via the first and second positioning plates (17 and 18). In this case, the laser head 25 is moved, in a pattern corresponding to cutting data, relative to the embroidery frame 2 fixedly set on the support members 27, so as to effect desired cutting (or strikethrough) operation.

Figure 8:
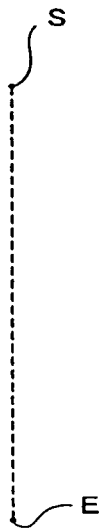
FIG. 8 is a view explanatory of positioning data used in the embodiment.

How to adjust the mounted position of the embroidery frame 2 on the laser processing machine is now briefed. This mounted position adjustment is carried out to allow the position of the embroidery frame 2 relative to the laser beam irradiation position to agree with the position of the embroidery frame 2 relative to the needle drop position P of the above-described embroidery sewing machine. First, the embroidery frame 2 is dismounted from the laser processing machine, and the positioning gauge 23 is attached in place of the embroidery frame 2. Then, the laser head 25 is moved, in response to operation on an operation panel, to cause the irradiation position of the laser beam to conform to the intersection point 24*a* of the positioning gauge 23. The laser head 25 is provided with an indicator (not shown) that is located near the upper surface of the positioning gauge 23, so that the laser head 25 can be positioned using the indicator. Then, the laser processing machine is caused to read positioning data as shown in FIG. 8. However, because the embroidery frame 2 is mounted in horizontal orientation at about 90 degrees to the laser processing machine unlike in the above-described embroidery sewing machine, the positioning data to be read by the laser processing machine have been rotated in advance through 90 degrees in accordance with the mounting orientation. After that, the laser processing machine is activated to move the laser head 25 to the E point on the basis of the positioning data. The laser irradiation is kept turned off during that time so that the laser head 25 reaches the E point without performing laser processing. After the laser head 25 has reached the E point, the human operator adjusts the position of the second support member 112 relative to the second positioning plate (18) in such a manner that the guide line 24 of the positioning gauge 23 agrees with the laser beams irradiation position. Then, the human operator manipulates the operation panel to return the laser head 25 to the start position (namely, return the irradiation position to the S point), after which the human operator ascertains whether the intersection point 24*a* of the positioning gauge 23 agrees with the laser beam irradiation position. If it has been determined that the intersection point 24*a* is displaced from the irradiation position, the human operator again performs the position adjustment. Thus, in the laser processing machine too, the irradiation position of the laser processing machine can be caused to agree with the intersection point 24*a* of the positioning gauge 23, and the position of the embroidery frame 2 relative to the irradiation position can be caused conform to the position of the embroidery frame 2 relative to the needle drop position P of the embroidery sewing machine.

With the arrangement that the position of the embroidery frame 2 relative to the irradiation position can be caused conform to the position of the embroidery frame 2 relative to the needle drop position P of the embroidery sewing machine, detachment/attachment operation of the embroidery frames 2 can be significantly simplified when the individual embroidery frame 2, subjected to the embroidering operation at the same positions on the multi-head sewing machine, are to be to attached to the laser processing machine.

Figure 11:
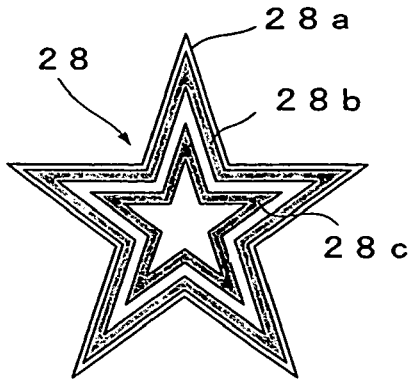
FIG. 11 is a view showing a workpiece embroidered and cut by an embroidery machine and laser machine in the embodiment.
Figure 12:
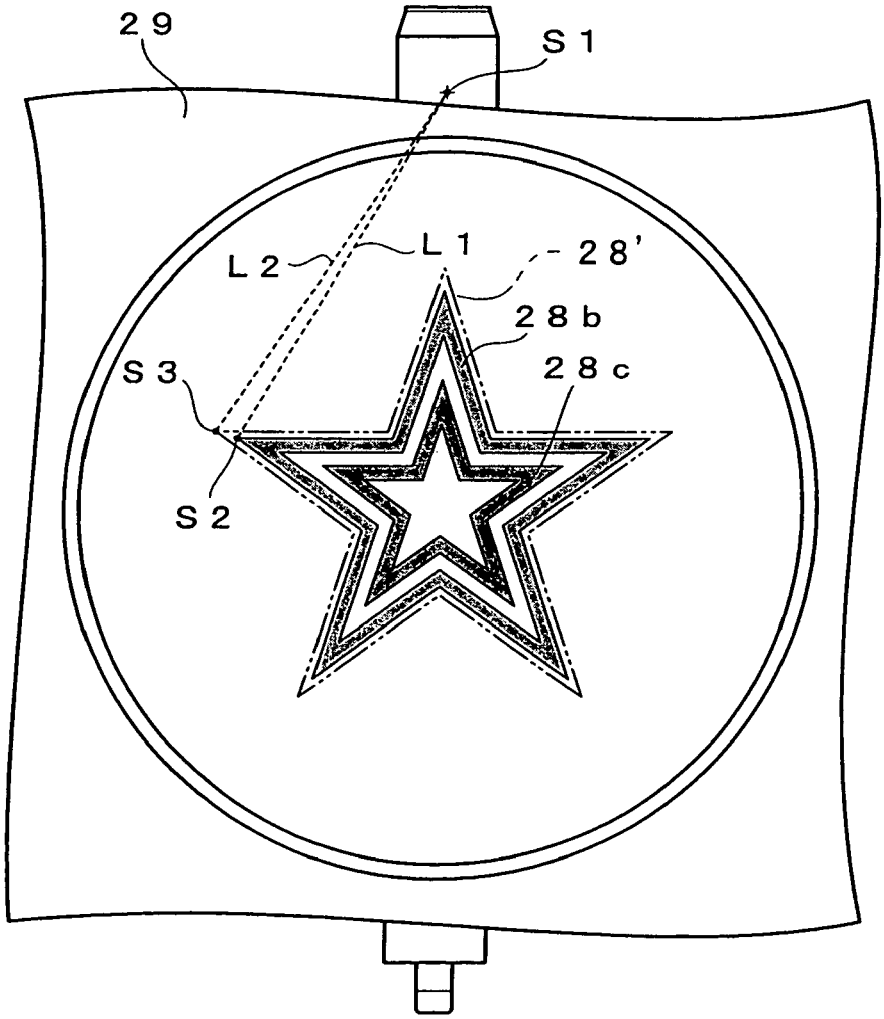
FIG. 12 is a view showing a foundation fabric on an embroidery frame before the workpiece of FIG. 11 is cut out from the foundation fabric.

FIG. 11 shows a cut workpiece 28 having embroideries provided thereon. More specifically, the cut workpiece 28 has an outer embroidery 28*b* and inner embroidery 28*c* provided on a star-shaped fabric piece 28*a*. This cut workpiece 28 is made, for example, by first making the embroideries 28*b* and 28*c* on a foundation fabric material 29 and then cutting the embroidered foundation fabric material into a star shape through laser processing, as illustrated in FIG. 12. Example of such operations is now explained. First, in order to perform desired embroidering, the embroidery frame 2 with the foundation fabric material 29 stretched thereon is attached to the base frame 1 of the embroidery sewing machine, and the embroidery sewing machine is caused to read embroidering data for making the embroideries 28*b* and 28*c* shown in FIG. 12. In the embroidering data, there are set a start point S2 and connecting data L1 from a point S1. The point S1 in the embroidering data is set such that the embroideries 28*b* and 28*c* are made centrally within the embroidery frame 2 when the point S1 is set in registration with the intersection point 24*a* of the positioning gauge 23. Then, the embroidery sewing machine is activated to make the embroideries 28*b* and 28*c* on the basis of the embroidering data. At the time of the activation of the embroidery sewing machine, the base frame 1 with the mounted position of the embroidery frame 2 kept adjusted is located in a position where the point S in the positioning data agrees with the needle drop position P, i.e. in a position where the intersection point 24*a* of the positioning gauge 23 agrees with the needle drop position P. Once the embroidery sewing machine is activated, the position where the intersection point 24*a* of the positioning gauge 23 agrees with the needle drop position P is stored as the point S1, and the base frame 1 moves over a distance corresponding to the connecting data L1 so that the start point S2 is positioned at the needle drop position P. At the time point when the start point S2 has reached the needle drop position P, the embroidery sewing machine starts embroidering. When the embroideries 28*b* and 28*c* have been completed, the base frame 1 is returned to the start point S1 (in this caser, the base frame 1 may be returned automatically), the embroidery frame 2 is detached from the base frame 1, and then the embroidery frame 2 with the foundation fabric material 29 still held thereon is attached to the laser processing machine. As set forth above, the position of the embroidery frame 2 relative to the irradiation position of the laser processing machine has been adjusted in a similar manner to the position of the embroidery frame 2 relative to the needle drop position P of the embroidery sewing machine.

The laser processing machine reads star-shape cutting data, as a laser cutting pattern, indicated by an imaginary line 28' of FIG. 12. In the cutting data, there are set a start point S3 and connecting data L2 from the point S1. In the illustrated example, the cutting data are data rotated through 90 degrees relative to the embroidering data in correspondence with a mounted orientation of the embroidery frame 2. Then, the laser processing is activated to perform laser cutting based on the cutting data, to thereby cut out the star-shaped fabric piece 28*a*. At the time of the activation of the laser processing machine too, the laser head 25 with the mounted position of the embroidery frame 2 kept adjusted is in a position where the start point S in the positioning data, i.e. the irradiation position, agrees with the intersection point 24*a* of the positioning gauge 23. Once the laser processing machine is activated, the position where the irradiation position agrees with the intersection point 24*a* of the positioning gauge is stored as the point S1, and the laser head 25 moves so that its irradiation position is set to the start point S3. At the time point when the laser head 25 has reached the point S3, the laser processing machine starts laser cutting.

Namely according to the instant embodiment, the connecting data L1 and L2 from the same point S1 are set in both the embroidering data and the laser cutting data. The start point S1 in the embroidering data is where the needle drop position agrees with the intersection point 24*a* of the positioning gauge 23, while the start point S1 in the cutting data is where the irradiation position agrees with the intersection point 24*a* of the positioning gauge 23. Therefore, even in the case where, after the embroideries 28*b* and 28*c* have been made by the embroidery sewing machine, the embroidery frame 2 is detached from the embroidery sewing machine and attached to the laser processing machine and then the fabric piece 28*a* is cut out, the thus-cut fabric piece 28*a* is aesthetically satisfactory with no positional deviation between the embroideries and the laser-cut position.

The embodiment of the present invention has been described above in relation to the case where the embroidery-starting position and the laser-cut-starting position are set appropriately using the embroidering data and laser cutting data having added thereto the respective connecting data L1 and L2 from the same point S1. Second embodiment, to be described below as another embodiment concerning such an aspect, is arranged in such a manner that a position of the base frame 1, where the intersection point 24*a* of the positioning gauge 23 has been set to conform to the needle drop position and irradiation position, can be stored in the embroidery sewing machine and laser processing machine, and that an embroidery start position (or point) and laser processing start position (or point) can be set by entering numerical values representative of distances from the reference position in the X and Y directions. The following paragraphs describe how the mounted position of the embroidery frame 2 is adjusted at that time.

First, in the multi-head embroidery sewing machine shown in FIG. 1, the embroidery frame 2 of the first machine head is detached, the first support member 6 is provisionally fixed centrally in the adjustment range, and then the positioning gauge 23 is attached in place. Then, the frame movement key is operated, on the operation panel of the embroidery sewing machine, to move the base frame 1 so that the intersection point 24*a* of the positioning gauge 23 is positioned in alignment with the needle drop position P. After that, the operation panel is operated to store, as the reference position, the position of the base frame 1 when the intersection point 24*a* of the positioning gauge 23 has been positioned in alignment with the needle drop position P.

After that, the frame movement key is operated to move the base frame 1 in the Y direction so that the front end, or a portion adjacent to the front end, of the guide line 24 of the positioning gauge 23 is positioned in alignment with the needle drop position P, and then the mounted position of the second support member 12 relative to the second positioning plate 18 is adjusted in such a manner that the guide line 24 of the positioning gauge 23 is positioned in alignment with the needle drop position P. Then, the operation panel is operated to return the base frame 1 to the stored reference position, and it is confirmed whether or not the intersection point 24*a* of the positioning gauge 23 is currently in alignment with the needle drop position P. If the intersection point 24*a* is not in alignment with the needle drop position P, the above-described operations are carried out again. If the intersection point 24*a* is in alignment with the needle drop position P, on the other hand, the first support member 6 having been temporarily fixed is fixed ultimately.

After that, the positioning gauge 23 is detached from the first machine head and then attached to the second machine head. The first support member 6 is temporarily fixed after being positionally adjusted so that the intersection point 24*a* of the positioning gauge 23 aligns with the needle drop position P of the second machine head. After that, the frame movement key is operated to move the base frame 1 in the Y direction so that the front end, or a portion adjacent to the front end, of the guide line 24 of the positioning gauge 23 is positioned in alignment with the needle drop position P, and then the mounted position of the second support member is adjusted in such a manner that the guide line 24 of the positioning gauge 23 is positioned in alignment with the needle drop position P. Then, the base frame 1 is returned to the stored reference position, and it is confirmed whether or not the intersection point 24*a* of the positioning gauge 23 is currently in alignment with the needle drop position P. If the intersection point 24*a* is currently in alignment with the needle drop position P, the mounted position of the embroidery frame 2 is fixed here. After that, the same operations as performed for the second machine head are sequentially repeated for the third, fourth and following machine heads. In this manner, the mounted position of the embroidery frame 2 can be adjusted for each of the machine heads.

When the mounted position of the embroidery frame 2 is to be adjusted in the laser processing machine as illustrated in FIG. 10, the human operator first attaches the positioning gauge 23 to the support members 27, moves the laser head 25 to adjust the laser irradiation position to the intersection point 24*a* of the positioning gauge 23, and then operates the operation panel so as to store the position of the laser head 25, where the laser irradiation position coincides with the intersection point 24*a*, into the laser processing machine as a reference position. Then, the human operator then operates the operation panel to move the laser head 25 in the X direction so as to set the laser irradiation position near the front end of the guide line 24 of the positioning gauge 23 and adjusts the mounted position of the second support member 112 so that the guide line 24 of the positioning gauge 23 coincides with the irradiation position. After that, the human operator brings the laser head 25 back to the reference position and confirms that the intersection point 24*a* of the positioning gauge 23 conforms to the laser irradiation position. In this way, the mounted position of the embroidery frame 2 can be adjusted.

Next, a description will be given about how the cut workpiece 28 of FIG. 11 is made. After the mounted position, on the embroidery sewing machine and laser processing machine, of the embroidery frame 2 has been adjusted in the above-described manner, the embroidery frame 2 with the foundation fabric material 29 held thereon in a stretched state is attached to the base frame 1. Then, embroidering data of embroideries 28*b* and 28*c* as illustrated in FIG. 12 are read into the embroidery sewing machine. In the second embodiment, embroidering data with no connecting data L1 may also be used. The human operator sets an embroidery start position, by operating the operation panel to enter, for both of the X and Y directions, numerical values pertaining to a distance from the reference position to a position where to start the desired embroidering. Let it be assumed here that, in the instant embodiment, the human operator enters numerical values of the distance from S1 to S2 indicated in FIG. 12. Then, the embroidery sewing machine is activated to make the embroideries 28*b* and 28*c*, starting at the set embroidery start position, on the basis of the read embroidering data.

Upon completion of the embroideries 28*b* and 28*c*, the embroidery frame 2 is detached from the embroidery sewing machine and then attached to the laser processing machine. Then, the laser processing machine is caused to read cutting data as indicated by an imaginary line 28' in FIG. 12. In the second embodiment, cutting data with no connecting data L2 may also be used. The human operator sets a laser cut start position, by operating the operation panel to enter, for both of the X and Y directions, numerical values pertaining to a distance from the reference position to a position where to start the laser cutting. Specifically, in the instant embodiment, the human operator enters numerical values of the distance from S1 to S3 (more specifically, numerical values rotated through 90 degrees because of the mounted orientation of the embroidery frame 2). Then, the laser processing is activated to perform the laser cutting, starting at the set laser cut start position, on the basis of the cutting data.

The second embodiment can make products aesthetically satisfactory with no positional deviation between the embroideries and the laser-cut position, in a similar manner to the first embodiment, by storing, as the reference positions, the positions where the intersection point 24*a* of the positioning gauge 23 has been adjusted to the needle drop position P and irradiation position and also setting the embroidery and laser cut start positions in terms of distances from the reference positions. Further, in the second embodiment, it is not necessary to use special embroidering data and cutting data with connecting data L1 and L2; namely, conventional or existing embroidering data and cutting data can be used as-is, which can achieve an enhanced efficiency. Further, because the positions where the intersection point 24*a* of the positioning gauge 23 has been adjusted to the needle drop position P and irradiation position are stored as the reference positions, it does not matter where the base frame 1 is located when the embroidery and laser cutting are to be performed, which can thereby achieve enhanced workability.

Whereas the embodiments have been described above in relation to the operations performed by a combination of the embroidery sewing machine and laser processing machine, the present invention is not so limited and may be applied to operations performed by a combination of the embroidery sewing machine and an embroidery sewing machine capable of sewing a strand-like member. Further, the embroidery sewing machine and laser processing machine may be constructed in any other suitable manner than the above-described.

Further, the base frame 1 in the embodiments has been described as being driven in the X and Y directions along the table surface. Alternatively, the embroider-frame mounting structure of the present invention may be applied to a base frame that, without being limited to planar or two-dimensional movement, is rotationally driven to perform embroidery on a hat or the like. In an alternative, any one of the other working members (such as the sewing needle or sewing head) may be moved without the base frame 1 being moved; namely, it is only necessary that the base frame 1 (or support members 27) be movable relative to the working member in accordance with desired working patterns, such as a desired sewing pattern and cutting pattern. Note that, in the claims of the present invention, the terms "base frame" generically refer to all components, including not only the base frame 1 driven in the two-dimensional plane but also the support members 27, which are movable relative to the working member (e.g., sewing needle or sewing head and laser head).

Furthermore, whereas the embroidery-frame mounting structure has been described in relation to the case where the mounting mechanisms (connection mechanisms 4 and 5) are removably mounted on the embroidery frame and removably mounted on the base frame 1 (or support members 27) via the positioning plates, i.e. where the two members, namely, mounting and positioning members, are provided between the embroidery frame and base frame (or support members 27), the present invention is not so limited. It is only necessary that the embroidery frame be attachable to the base frame (or support members 27), in such a manner as to be adjustable in mounted position relative to the base frame (or support members 27), via a positioning member removably fixed to the base frame (or support members 27) at a predetermined position. For example, the embroidery-frame mounting structure may comprise a mechanism integrally equipped with the function as a mounting member and the function as a positioning member.

Further, the removable securing means for securing the embroidery frame 2 to the mounting members (support members 6, 12, 106 and 112) may be other than the one employing magnets as described above, such as one employing suitable engagement means utilizing a spring action, hooks, etc. Further, the structure for adjusting the mounted position of the mounting members (support members 6, 12, 106 and 112) relative to the positioning members (positioning plates 17 and 18) may be constructed in any desired manner without being limited to the above-described structure including the mounted-position adjusting holes (6*b*, 12*b*) and screws (19, 21) loosely engaging the holes.

As having been set forth above, the present invention includes the positioning member to be removably fixed to the base frame at a predetermined position, and the mounting members, mounted via the positioning member on the base frame, for mounting the embroidery frame on the base frame. Further, in the present invention, the mounting members for mounting the embroidery frame on the base frame are mounted on the base frame via the positioning member and the mounted position of the mounting members relative to the positioning member is adjustable, so that, by detaching the mounting members from the base frame with the mounting members still kept attached to the positioning member, it is possible to eliminate a need to repeat adjustment of the mounted position each time attachment/detachment of the mounting members is to be carried out. Therefore, the attachment/detachment of the mounting members can be carried out with a high efficiency, and thus, in embroidery sewing machines with a plurality of machine heads too, the present invention can accomplish the superior benefits that it can reduce a time when the embroidery sewing machine has to be kept deactivated due to attachment/detachment of the mounting members and can thereby achieve an enhanced production efficiency.

The invention claimed is:

1. An embroidery-frame mounting structure for mounting an embroidery frame, for holding an embroidering fabric in a spread-out condition, on a base frame driven relative to a tool, said embroidery-frame mounting structure comprising:

first and second positioning members that detachably mount to the base frame at two predetermined positions; and first and second mounting members that detachably and adjustably mount respectively to said first and second positioning members;

wherein the first mounting member includes a first adjustment device for adjustably mounting the first mounting member relative to the first positioning member and for maintaining an adjusted mounting position of the first mounting member relative to the first positioning member, wherein the second mounting member includes a second adjustment device for adjustably mounting the second mounting member relative to the second positioning member and for maintaining an adjusted mounting position of the second mounting member relative to the second positioning member, wherein said embroidery frame is adjustably mounted on the base frame via said mounting members and said positioning members, said embroidery frame, said mounting members, and said positioning members are attachable and detachable together as a unit by attaching and detaching said positioning members to and from said base frame, while maintaining the first and second mounting members in the adjusted mounting positions relative to the first and second positioning members, and wherein said embroidery frame is separately attachable and detachable to and from said first and second mounting members.

2. An embroidery-frame mounting structure as claimed in claim 1, wherein the first and second adjustment devices each comprise a mounted-position adjusting hole formed in the respective mounting member and a screw loosely engaged in the mounted-position adjusting hole, and wherein each of said mounting members is mounted on the respective positioning member by first adjusting the mounted position of each of the mounting members relative to the respective positioning member and then fastening the respective screw.

3. An embroidery-frame mounting structure as claimed in claim 1, wherein each of said positioning members is fixed to the base frame via a screw.

4. An embroidery-frame mounting structure as claimed in claim 1, wherein a structure for allowing said embroidery frame to be detachably attached to said mounting members comprises a fitting structure and a magnet.

5. An embroidery-frame mounting structure for mounting an embroidery frame, for holding an embroidering fabric in a spread-out condition, on a base frame driven relative to a tool, said embroidery-frame mounting structure comprising:

a positioning member that removably mounts to the base frame at a predetermined position;

a mounting member that removably mounts to said positioning member;

at least one first screw for mounting the mounting member to the positioning member; and at least one second screw for mounting the positioning member to the base member, wherein said mounting member is adjustably mounted to said positioning member so that a mounted position thereof is adjustable relative to said positioning member to allow said embroidery frame to be adjustably and removably mounted on the base frame via said mounting member and said positioning member, wherein said mounting member includes a mounted-position adjusting hole formed in said mounting member, the mounted-position adjusting hole having a sufficient clearance to allow the mounting member to adjust relative to the positioning member while the first screw is inserted into the base member, and wherein said mounting member further includes an escape hole having a clearance sufficiently large to allow the second screw to pass through and secure the positioning member to the base frame without interfering with the adjustability of said mounting member relative to said positioning member.

* * * * *